US010814347B2

(12) United States Patent
Xia et al.

(10) Patent No.: US 10,814,347 B2
(45) Date of Patent: Oct. 27, 2020

(54) CAULKING GUN

(71) Applicant: ZHEJIANG VOLCANO MACHINERY CO., LTD., Jinhua, ZheJiang (CN)

(72) Inventors: Le Xia, ZheJiang (CN); Suhua Zhang, ZheJiang (CN); Weidong Shen, ZheJiang (CN)

(73) Assignee: ZHEJIANG VOLCANO MACHINERY CO., LTD., Zhejiang (CN)

( * ) Notice: Subject to any disclaimer, the term of this patent is extended or adjusted under 35 U.S.C. 154(b) by 0 days.

(21) Appl. No.: 16/416,618

(22) Filed: May 20, 2019

(65) Prior Publication Data

US 2019/0299244 A1 Oct. 3, 2019

(30) Foreign Application Priority Data

Jun. 7, 2018 (CN) ..... 2018 1 0579740
Jun. 21, 2018 (CN) ..... 2018 1 0643912

(51) Int. Cl.
*B05C 17/005* (2006.01)
*B05C 17/01* (2006.01)

(52) U.S. Cl.
CPC .... *B05C 17/00593* (2013.01); *B05C 17/0052* (2013.01); *B05C 17/00596* (2013.01); *B05C 17/01* (2013.01); *B05C 17/0123* (2013.01)

(58) Field of Classification Search
CPC ..... B05C 17/00593; B05C 17/00596; B05C 17/0052; B05C 17/0123; B05C 17/01
USPC ..... 222/326, 327, 391
See application file for complete search history.

(56) References Cited

U.S. PATENT DOCUMENTS 2,732,102 A * 1/1956 Ekins ..... B05C 17/0126 222/327
3,311,265 A * 3/1967 Creighton, Jr. ... B05C 17/00516 222/137
4,330,070 A * 5/1982 Doubleday ..... G01F 11/023 222/287
4,471,888 A * 9/1984 Herb ..... B05C 17/00553 222/137
4,681,524 A * 7/1987 Ikeda ..... B05C 17/0123 222/326
5,197,635 A * 3/1993 Chang ..... B05C 17/00553 222/137

(Continued)

*Primary Examiner* — Patrick M. Buechner
*Assistant Examiner* — Randall A Gruby
(74) *Attorney, Agent, or Firm* — Muncy, Geissler, Olds & Lowe, P.C.

(57) ABSTRACT

A caulking gun includes a push disk, a push rod, an adhesive cartridge compartment, a trigger and a gun body; the trigger is hingedly coupled to the middle part of the gun body; the rear end of the push rod is outside the gun body and provided with a braking device; the front end is in the adhesive cartridge compartment through the gun body and provided with a push disk; a push piece for driving the push rod is mounted in the gun body; the front end of the push piece is provided with a return spring; the trigger is provided with a pin position switching device for adjusting the propulsion ratio by adjusting the contact position of the push piece; adjustment of different propulsion ratios enables the caulking gun to be multifunctional to meet the construction requirements of different adhesives.

3 Claims, 5 Drawing Sheets

(56) References Cited

U.S. PATENT DOCUMENTS

| | | | | |
|---|---|---|---|---|
| 5,314,092 | A * | 5/1994 | Jacobsen | B05C 17/00513 222/137 |
| 5,381,931 | A * | 1/1995 | Chang | B05C 17/01 222/309 |
| 5,720,418 | A * | 2/1998 | Timmerman | B05C 17/00553 222/309 |
| 6,089,412 | A * | 7/2000 | Snell | B05C 17/01 222/214 |
| 7,959,039 | B2 * | 6/2011 | Beckett | B05C 17/0123 222/391 |
| 7,971,758 | B2 * | 7/2011 | Campbell | B05C 17/0123 222/391 |
| 8,087,550 | B2 * | 1/2012 | Schneider | B05C 17/00576 222/325 |
| 8,444,018 | B2 * | 5/2013 | Strobel-Schmidt | B05C 17/00596 83/54 |
| 8,528,793 | B2 * | 9/2013 | Brummitt | B65D 83/0072 222/327 |
| 8,857,673 | B2 * | 10/2014 | Szpak | B05C 17/014 222/391 |
| 8,904,910 | B2 * | 12/2014 | Marsden | B05C 17/00596 83/54 |
| 9,302,290 | B2 * | 4/2016 | Szpak | B65D 83/0033 |
| 9,827,588 | B2 * | 11/2017 | Hung | B05C 17/0123 |
| 10,016,781 | B2 * | 7/2018 | Poppe | B05C 17/0126 |
| 10,201,829 | B2 * | 2/2019 | Hung | B05C 17/01 |
| 2012/0031931 | A1 * | 2/2012 | Strobel-Schmidt | B05C 17/014 222/391 |
| 2015/0258569 | A1 * | 9/2015 | Roe | B65D 83/0072 222/327 |

* cited by examiner

CAULKING GUN

CROSS-REFERENCE TO RELATED APPLICATION

The present application relies on, for priority, China Patent Application No. 201810579740.3 entitled "caulking gun with a cartridge pressure release switching device", filed on Jun. 7, 2018, and China Patent Application No. 201810643912.9 entitled "caulking gun with a pin position switching device", filed on Jun. 21, 2018. The subject matter of each is incorporated by reference herewith in entirety.

BACKGROUND OF THE INVENTION

Technical Field

This invention relates to caulking guns.

Description of Related Art

A caulking gun is usually a mechanical squeezing tool that uses the principle of lever to rubberizing. When used in combination with an adhesive cartridge or adhesive stick, the adhesive can be easily pressed out from the front end of the adhesive cartridge to improve the rubberizing efficiency. Therefore, the caulking gun is widely used in the fields of architectural decoration, automobile industry, hardware tools and the like.

However, the propulsion ratio of the common caulking guns currently on the market is fixed, so that one caulking gun can not meet the construction requirements of different types of adhesives at the same time, therefore, it is necessary to equip multiple caulking guns at the same time in case of need.

At present, caulking guns of various types and purposes on the market come out in an endless stream. However, since the diameter of the output of the adhesive cartridge is smaller than the diameter of the piston inside the adhesive cartridge, in the impelling operation of a conventional caulking gun, the pressure inside the adhesive cartridge will rise, and a pressure difference is formed between the adhesive outlet and the inside of the adhesive cartridge. If the pressing operation is stopped at this time, the adhesive inside the adhesive cartridge will continue to overflow from the adhesive output under the action of pressure until the pressures inside and outside the adhesive cartridge are equal, what's more, the adhesive push rod of the conventional caulking gun can only advance in one direction and adhesive breaking can only be operated manually, which can only meet the requirements under a single construction condition, and in most cases, it will not only cause inconvenience in use, but also lead to a large waste of adhesive material.

BRIEF SUMMARY OF THE INVENTION

In order to overcome the deficiencies of the prior art, the present invention proposes an innovative caulking gun, which has the effect of 'one gun for multi-purpose' to meet the construction requirements of different kinds of adhesives, and is convenient to manufacture and adjust, and is easy to realize the adjustment of the amount of gel breaking, to meet the needs of different applications of the caulking gun, so as to achieve the purpose of improving the adaptability of its construction operation, reducing adhesive waste and saving social resources.

The technical solution adopted by the present invention is:

A caulking gun includes a push disk, a push rod, an adhesive cartridge compartment, a trigger and a gun body; the trigger is hingedly coupled to the middle part of the gun body and cooperate with the lower part of the gun body to squeeze the adhesive, and the adhesive cartridge compartment is disposed at the front end of the gun body; the rear end of the push rod is located outside the gun body, and the front end of the push rod passes through the gun body and is disposed in the adhesive cartridge compartment; the push disk is disposed at the front end of the push rod, and the rear end of the push rod is provided with a braking device; a push piece for driving the push rod is mounted in the gun body, and the front end of the push piece is provided with a return spring; wherein the trigger is provided with a pin position switching device for adjusting a propulsion ratio; the pin position switching device comprises a camshaft pin that is rotatable and can be positioned in the corresponding gear; the camshaft pin having a first cam portion for cooperating with the gear to fix a position and a second cam portion for contacting with the push piece to adjust the propulsion ratio; the first cam portion and the second cam portion are synchronously rotated and positioned. The present invention adjusts the contact position of the push piece of the caulking gun by the pin position switching device, realizing the adjustment of different propulsion ratios, and enables the caulking gun to have the effect of 'one gun with multiple usages' to meet the construction requirements of different kinds of adhesives; when the cam portion rotates and shifts the gear position, the second cam portion can be synchronously rotated, thereby adjusting the contact position between the cam shaft pin and the push piece, thus realizing the adjustment of different propulsion ratios.

Further, the camshaft pin includes a cylindrical pin; the first cam portion is disposed at a first end of the cylindrical pin, and the second cam portion is disposed at the middle portion of the cylindrical pin; a second end passes through the trigger and the gun body to fixedly connected with the screw that can drive the camshaft pin to move axially away from the corresponding gear position; the outer surface of the second end of the cylindrical pin is provided with a compression spring, and the compression spring is located between the inner side of the screw end head and the trigger. The present invention drives the camshaft pin position to switch freely by pressing and rotating the screw; the present invention drives the camshaft pin axially to be reset and positioned in the corresponding gear position by the compression spring.

Further, the upper part of the trigger is a U-shaped opening, the gun body is inserted into the U-shaped opening and is pin-jointed to the trigger by a pin, and the trigger can be rotated around the gun body axis by the pin; a plurality of groove positions which cooperate with the first cam portion for positioning are provided on one side of the U-shaped opening where the camshaft pin is located; the groove positions are cam-shaped through holes, and the structure thereof is consistent with the first cam portion.

Further, the end of the pin is provided with an anti-drop unit that prevents it from coming off the trigger and the gun body.

Alternatively, the end of the pin is a rivet-flanging structure.

Further, the upper part of the gun body is provided with a cartridge pressure release switching device that is rotatable between a first position and a second position, and when the adhesive cartridge pressure release switching device is in the first position, it is in contact with a brake plate. During the rubberizing process of the caulking gun, the pressure of the adhesive cartridge is in a holding state, and when the adhesive cartridge pressure release switching device is in the second position, it is separated from the brake plate, and the pressure of the adhesive cartridge is in a releasing state during the rubberizing process of the caulking gun; the adhesive cartridge pressure release switching device includes a rotary switch, an resilient device for stabilizing the rotary switch in the first position or the second position, and a limiting structure that cooperates with the resilient device for limiting; the rotary switch including a cam portion, and a shifting part is provided on a circumferential surface of the portion, and when the rotary switch is in the first position, the protruding portion of the cam portion is in contact with the brake plate, and when the rotary switch is in the second position, the protruding portion of the cam portion is separated from the brake plate. The present invention achieves the purpose of the amount adjustment of gel breaking of the caulking gun by the cartridge pressure release switching device, so as to meet the requirements of different use occasions of a caulking gun, so as to improve the adaptability of the construction operation, reduce the colloid waste, and save the social resources. The present invention rotates the rotary switch by poking the shifting part of the cam portion, thereby controlling the stroke between the cam portion and the brake plate, thereby realizing the switching of the pressure release function of the adhesive cartridge and satisfying different requirements for the amount of glue-breaking for different adhesives.

Further, the rotary switch further comprises a rotating shaft which passes across the gun body; said cam portion is disposed at one end of the rotating shaft, and the middle portion of the rotating shaft is provided with a receiving hole for mounting the resilient device; the other end portion of the rotating shaft is provided with an elastic inverted portion; the limiting structure is disposed on the gun body, and is a limiting through hole through which the rotating shaft penetrates, and the limiting through hole is provided with a concave and convex gear cooperating with the resilient device for limiting; the outer diameter of the elastic inverted portion is greater than the inner diameter of the limiting through hole.

Alternatively, the rotary switch includes a left rotary portion and a right rotary portion, and the left rotary portion and the right rotary portion are each provided with a cam portion and a rotating shaft, and the rotating shafts of the left rotary portion and the right rotary portion are fixedly connected with each other and then being disposed across the gun body; the cam portions of the left rotary portion and the right rotary portion are oppositely disposed to improve the stability of switching.

Further, the gun body is provided with a limiting hole for mounting the resilient device and a positioning hole for the rotating shaft to pass through; the limiting structure is two dimples disposed on the inner side of one of the cam portions.

A caulking gun includes a push disk, a push rod, an adhesive cartridge compartment, a trigger and a gun body; the trigger is hingedly coupled to the middle part of the gun body and cooperates with the lower part of the gun body to squeeze the adhesive, and the adhesive cartridge compartment is disposed at the front end of the gun body; the rear end of the push rod is located outside the gun body, and the front end of the push rod is equipped through the gun body and locates in the adhesive cartridge compartment; the push disk is disposed at the front end of the push rod, and the rear end of the push rod is provided with a braking device; a push piece for driving the push rod to be advanced is mounted in the gun body, and the front end of the push piece is provided with a return spring; wherein the upper part of the gun body is provided with a cartridge pressure release switching device that is rotatable between a first position and a second position; when the cartridge pressure release switching device is in the first position, it is in contact with a brake plate and the pressure of the adhesive cartridge is in a holding state during the rubberizing process of the caulking gun; when the cartridge pressure release switching device is in the second position, it is separated from the brake plate, and the pressure of the adhesive cartridge is in a releasing state during the rubberizing process of the caulking gun; wherein the cartridge pressure release switching device comprises a rotary switch, an resilient device for stabilizing the rotary switch in the first position or the second position, and a limiting structure that cooperates with the resilient device for limiting; the rotary switch comprises a cam portion, and a shifting part is provided on a circumferential surface of the cam portion; when the rotary switch is in the first position, the protruding portion of the cam portion is in contact with the brake plate, and when the rotary switch is in the second position, the protruding portion of the cam portion is separated from the brake plate. The present invention achieves the purpose of adjusting the amount of gel-breaking of the caulking gun by the cartridge pressure release switching device, so as to meet the requirements of different use occasions of caulking gun, so as to improve the adaptability of its construction operation, reduce the colloid waste, and save the social resources. The present invention rotates the rotary switch by poking the shifting part of the cam portion, thereby controlling the stroke between the cam portion and the brake plate, thereby realizing the switching of the pressure release function of the adhesive cartridge and satisfying requirements of different amounts of gel-breaking for different adhesives.

Further, the rotary switch further comprises a rotating shaft which passes across the gun body; said cam portion is disposed at one end of the rotating shaft, and the middle portion of the rotating shaft is provided with a receiving hole for mounting the resilient device; the other end portion of the rotating shaft is provided with an elastic inverted portion; the limiting structure is disposed on the gun body, and is a limiting through hole through which the rotating shaft penetrates, and the limiting through hole is provided with a concave and convex gear that cooperates with the resilient device for limiting; the outer diameter of the elastic inverted portion is greater than the inner diameter of the limiting through hole.

Alternatively, the rotary switch comprises a left rotary portion and a right rotary portion, and the left rotary portion and the right rotary portion are each provided with a cam portion and a rotating shaft, and the rotating shafts of the left rotary portion and the right rotary portion are fixedly connected with each other and then being disposed across the gun body; the cam portions of the left rotary portion and the right rotary portion are oppositely disposed to improve the stability of switching.

Further, the gun body is provided with a limiting hole for mounting the resilient device and a positioning hole for the rotating shaft; the limiting structure is two dimples disposed on one side of the cam portions.

Further, the gun body is provided with a limiting post, and the inner side of the cam portion is provided with a limiting slot, and the limiting post is located in the limiting slot to limit the rotation angle of the cam portion, thereby enhancing the stability of the limiting structure.

Further, the resilient device includes a limiting body for limiting and an elastic body for providing a supporting force to the limiting body, preferably a compression spring and a ball.

Further, an outer surface of the cam portion is provided with a pressure releasing switching indication mark.

The beneficial effects of the invention:

1. The user can push and rotate the screw to drive the camshaft pin position to switch freely to realize adjustment of different propulsion ratios, so that the caulking gun has the effect of 'one gun of multi-purpose usages' and meet the construction requirements of different kinds of adhesives. It is easy to manufacture and adjust and easy to implement, thus it saves social resources.

2. The user can freely switch the cartridge pressure release switching device to open or close by the rotary switch, so that the caulking gun has the function of controlling the adhesive to be broken for multiple amounts by multiple segments, so that the caulking gun becomes multi-purpose.

3. An resilient device is provided in the cartridge pressure release switching device, which makes the switching position more stable, and sounds a reminder when the function is switched, so that the operation is more humanized.

DETAILED DESCRIPTION OF THE PREFERRED EMBODIMENTS

The present invention is further illustrated by the following examples, but the invention is not limited to the specific embodiments. Those skilled in the art will recognize that the invention encompasses all alternatives, modifications, and equivalents that may be included within the scope of the claims.

Embodiment 1

Figure 1:
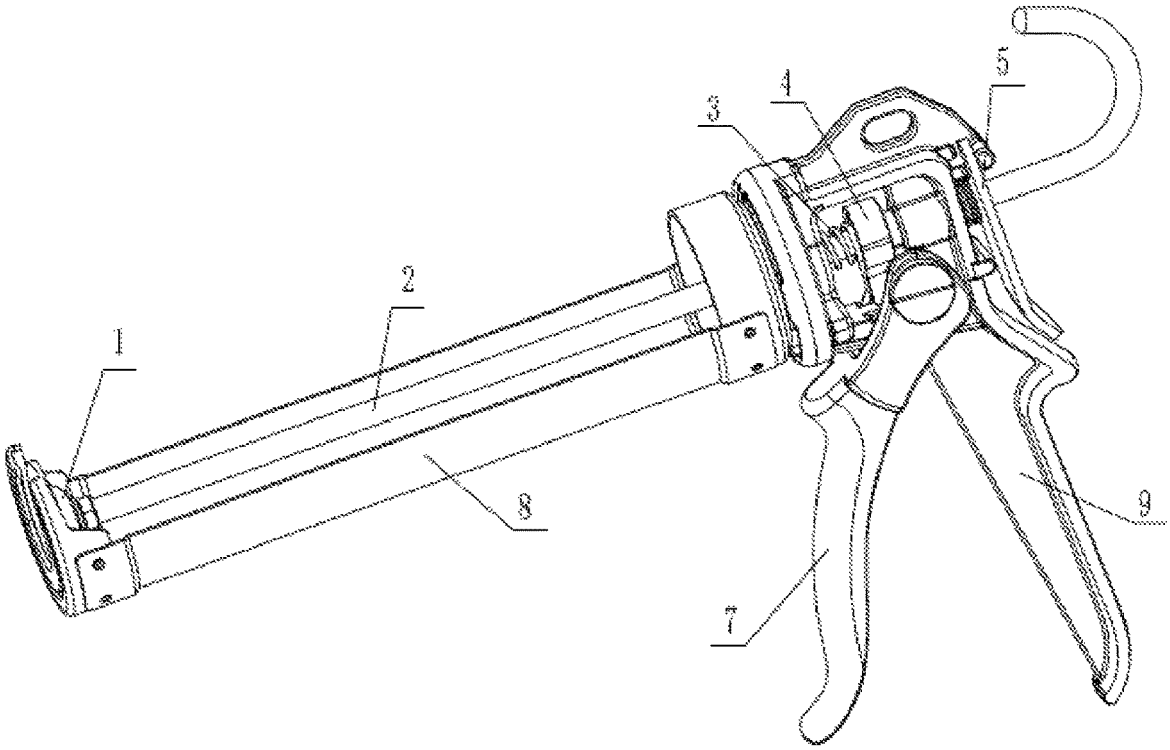
FIG. 1 is a schematic view showing the structure of the first embodiment of the present invention.
Figure 2:
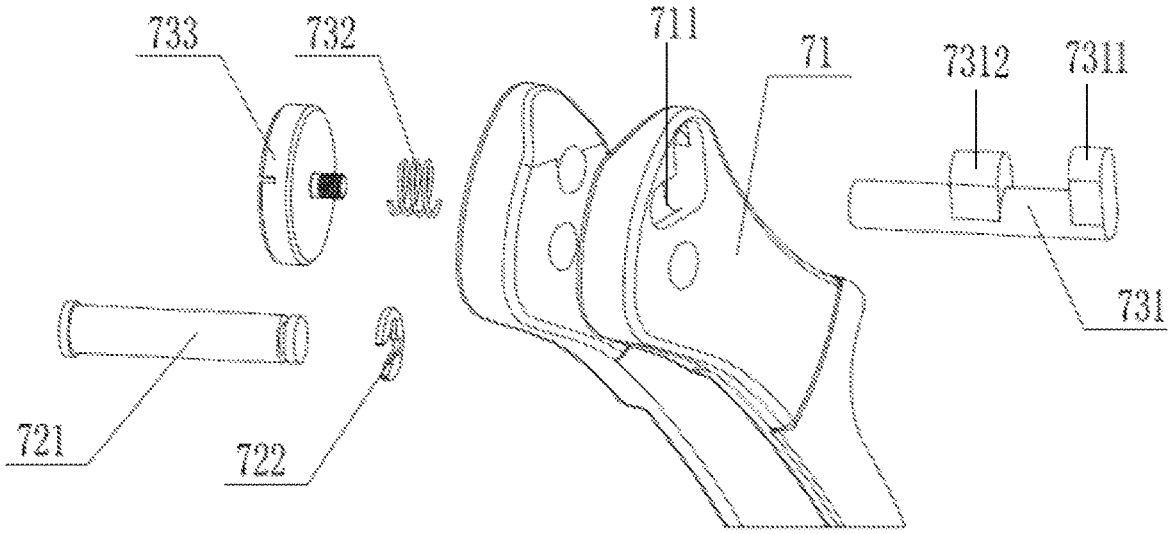
FIG. 2 is an schematic exploded view showing the structure of the pin position switching device of the present invention.

Referring to FIG. 1 and FIG. 2, Embodiment 1 provides a caulking gun including a pin position switching device, including a push disk 1, a push rod 2, an adhesive cartridge compartment 8, a trigger 7 and a gun body 9. The trigger 7 is hinged to the middle of the gun body 9 by the pin 721 to cooperate with the lower part of the gun body 9 for rubberizing. The adhesive cartridge compartment 8 is disposed at the front end of the gun body 9. The rear end of the push rod 2 is located outside the gun body 9, and the front end of the push rod 2 passes through the gun body 9 and locates in the adhesive cartridge compartment 8, the push disk 1 is disposed at the front end of the push rod 2, the rear end of the push rod 2 is provided with a braking device, and the gun body 9 is mounted with a push piece 4 for driving the push rod 2 to advance. The push piece 4 is provided with a return spring 3 at the front end of the push piece 4; the trigger 7 is provided with a pin position switching device for adjusting the advancement ratio. The present invention adjusts the position where the push piece 4 of the caulking gun contacts through the pin position switching device, realizing the adjustment of different propulsion ratios, therefore enables the caulking gun to have the effect of 'one gun for multiple purposes' to meet the construction requirements of different kinds of adhesives.

The pin position switching device of this embodiment includes a cam shaft pin 731, a compression spring 732, and a screw 733. The camshaft pin 731 is rotatable and is able to positioned in a corresponding gear position, the camshaft pin 731 has a first cam portion 7311 that cooperates with the gear for positioning and a second cam portion 7312 for contacting the push piece 4 to adjust its propulsion ratio, the first cam portion 7311 and the second cam portion 7312 are installed to rotate synchronously. When the first cam portion 7311 of the present invention rotates and shifts the gear position, the second cam portion 7312 can be synchronously rotated to adjust the contact position with the push piece 4, thereby achieving adjustment of different propulsion ratios. The camshaft pin 731 includes a cylindrical pin, the first cam portion 7311 is disposed at a first end of the cylindrical pin, and the second cam portion 7312 is disposed at a middle portion of the cylindrical pin; a second end of the cylindrical pin passes through the trigger 7 and the gun body 9 and is screwed with a screw 733 that rotates after the camshaft pin 731 is axially moved away from the corresponding gear position. The present invention drives the position of the camshaft pin 731 to be freely switched by pressing and rotating the screw 733. The outer surface of the second end of the cylindrical pin is sheathed with a compression spring 732 having a diameter smaller than the diameter of the end surface of the screw 731, and the compression spring 732 is located between the inner end surface of the screw 731 and the trigger 7. The present invention drives the camshaft pin 731 to axially reset and locates in the corresponding gear position by the compression spring 732. The height of the second cam portion 7312 is smaller than the height of the first cam portion 7311, facilitating the passage of the cam shaft pin 731. Of course, the structure of the first cam portion and the second cam portion in the present invention is not limited to the cam structure, and may be a columnar shape, a strip shape, a rib shape or even a tooth shape.

In Embodiment 1, the upper part of the trigger 7 has a U-shaped opening 71, and each side of the opening 71 is respectively provided with a upper pin hole and a lower pin hole perpendicular thereto, wherein one side of the upper pin holes is a circular through hole, and the opposite side is provided with a cam-shaped through hole and two groove positions 711 are provided on the outer side thereof, and the structure of the cam-shaped through hole conforms to the first cam portion. The camshaft pin can pass through the upper pin holes from this end in order and project from the other end, and the camshaft pin 731 can be rotated in the radial direction of the upper pin holes, and move in the axial direction thereof. Both sides of the lower pin holes are through holes through which the pin 721 can pass and couple the through holes with the gun body 9; the trigger 7 rotates with the pin 721 as an axis. The end of the pin 721 is provided with an anti-drop unit 722 for preventing it from coming off the trigger 7 and the gun body 9, or the end portion of the pin 721 may be rivet-flanged to prevent it from coming off the trigger 7 and the gun body 9.

When the adhesive is applied, the position of the camshaft pin 731 can be switched to adjust the propulsion ratio to meet the construction requirements of different types of adhesives. The specific switching operation is as follows: by hand pressing the screw 733 on the opening 71 of the trigger 7 to drive the cam shaft pin 731 connected thereto and fixed therewith to generate an axial displacement along the axis of the circular through hole of the upper pin holes, and the inner end surface of the cam portion 7311 is then higher than a side of the outer end surface of the opening 71 on which side the groove positions are provided, and then rotate the cam shaft pin 731, and release the handle when the first cam portion 7311 is aligned with the other groove position, and under the action of the elastic force of the pressure spring 732, the cam shaft pin 731 is automatically retracted, and the first cam portion 7311 is engaged in the groove. At this time, the second cam portion 7312 in the middle of the cam shaft pin 731 is also synchronously rotated, so that the contact position with the push piece 4 is changed, thereby realizing position switching, thereby realizing adjustment of the propulsion ratio. On the other hand, when the advancement ratio needs to be adjusted back, just reversely rotate the cam shaft pin 731 in the same manner, and the first cam portion 7311 is then re-engaged into the initial position of the inner groove to realize position switching.

The user of the present invention can drive the position of the camshaft pin 731 to be freely switched by pressing and rotating the screw 733 to realize different adjustment of the propulsion ratio, so that the caulking gun has the effect of 'one gun of multiple usages' to meet the construction requirements of different kinds of adhesives. Moreover, it is easy to manufacture and adjust, easy to implement, and saves social resources.

Embodiment 2

Figure 3:
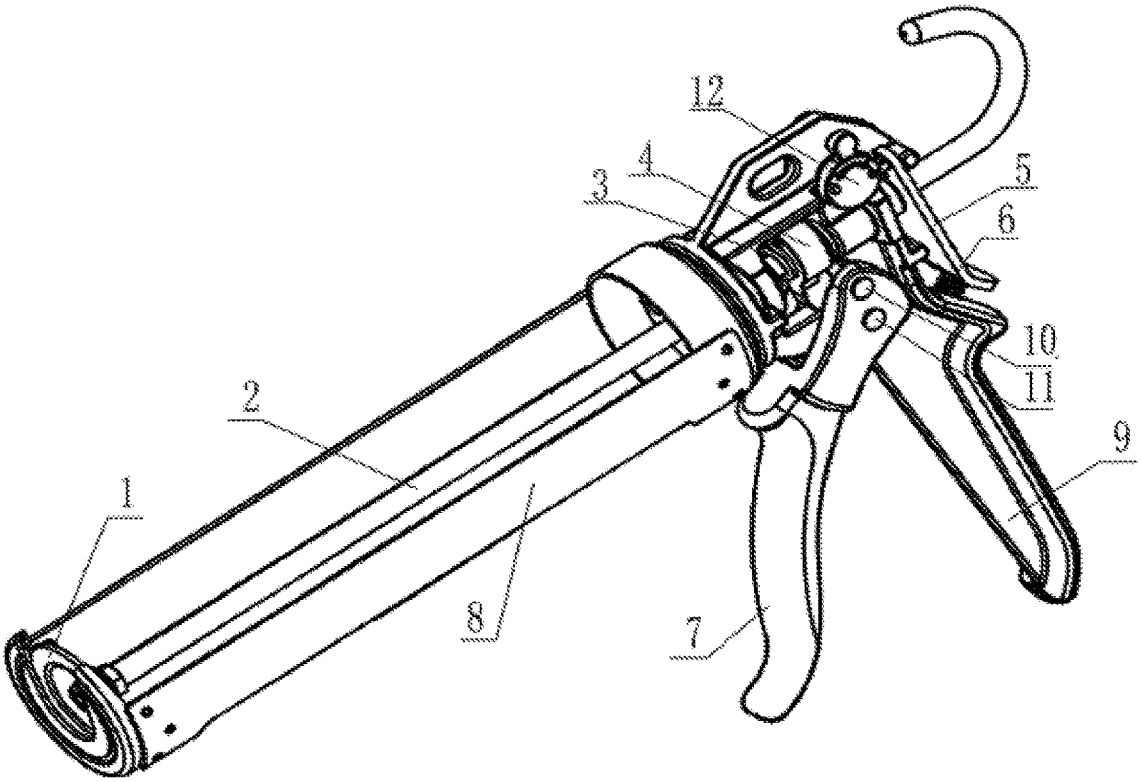
FIG. 3 is a schematic view showing the structure of the second embodiment of the present invention.

As shown in FIG. 3, Embodiment 2 provides a caulking gun equipped with a cartridge pressure release switching device, which comprises a push disk 1, a push rod 2, an adhesive cartridge compartment 8, a trigger 7 and a gun body 9. The upper part of the gun body 9 is a frame structure, and a through hole for the push rod 2 to pass through is provided in a horizontal direction; a push piece 4 for driving the push rod 2 to advance is mounted in the frame of the gun body 9. A reset spring 3 is provided at the front end of the push piece 4. A brake plate 5 is disposed outside the frame of the gun body 9 and at the rear end of the push rod, and a brake compression spring 6 is disposed between the gun body 9 and the brake plate 5. The middle portion of the gun body 9 is provided with a through hole perpendicular to the frame body, so that the trigger 7 and the gun body 9 are pin-connected, and cooperate with the handle of the lower half of the gun body 9 to realize the adhesive pressing action. The upper portion of the gun body 9 is provided with a rotatable cartridge pressure release switching device 12 which is pin-connected with the gun body 9. The cartridge pressure release switching device 12 is rotatable between a first position and a second position, and when in the first position, is in contact with the brake plate, and the pressure of the adhesive cartridge is maintained during the rubberizing process of the caulking gun. When in the second position, it is separated from the brake plate, and the pressure of the adhesive cartridge is released during the rubberizing process.

Figure 4:
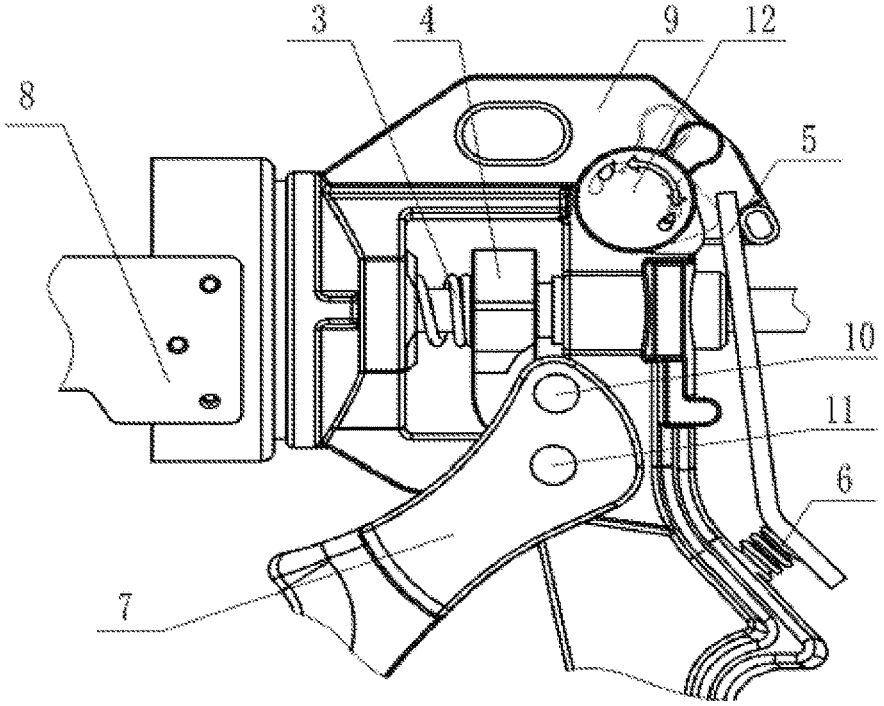
FIG. 4 is a partial schematic view of the cartridge pressure release switching device of FIG. 3.
Figure 5:
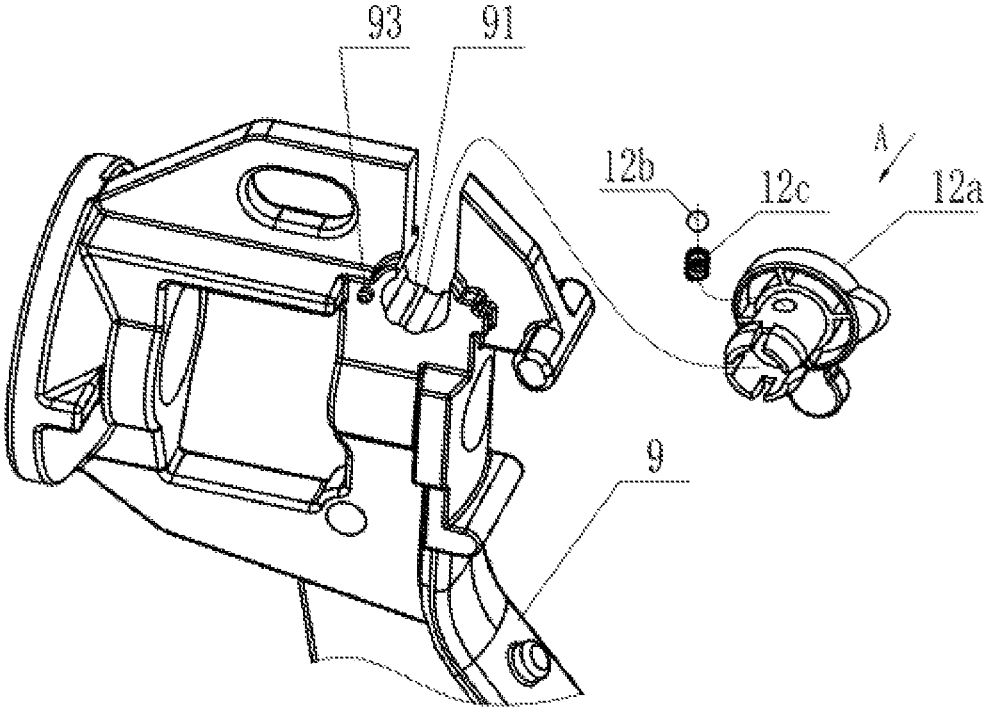
FIG. 5 is a schematic exploded view of FIG. 2.
Figure 6:
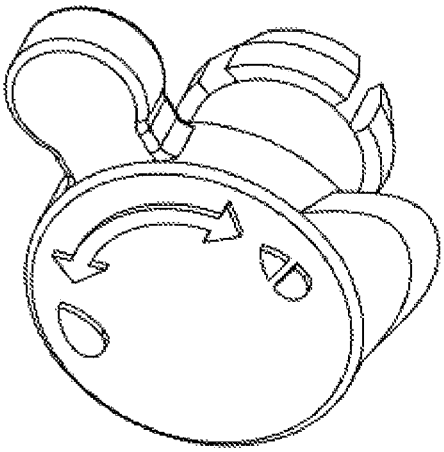
FIG. 6 is a view taken along the line A in FIG. 5.

As shown in FIG. 4-6, the cartridge pressure release switching device 12 includes a rotary switch 12*a* and a resilient device for stabilizing the rotary switch 12*a* in the first position or the second position and a limiting structure in cooperation with the resilient device. When the rotary switch 12*a* is turned to the corresponding limiting structure, the pressure release of the adhesive cartridge can be realized. The rotary switch 12*a* and the gun body 9 are connected together by a pin connection by the shaft of the rotary switch 12*a*. The rotary switch 12*a* has an elastic inverted portion at one end of the shaft, a cam portion at the other end, and a dial portion on the cam portion. When the rotary switch 12*a* is in the first position, the projection portion of the cam portion comes into contact with the brake plate 5, and when the rotary switch 12*a* is in the second position, the projection portion of the cam portion is separated from the brake plate 5.

The outer end surface of the cam portion is provided with a pressure release switching indication mark.

The resilient device includes a limiting body for limiting and a resilient body for providing a supporting force to the limiting body; the limiting body is preferably a ball 12*b*; the resilient body is preferably a compression spring 12*c*, and the resilient device is disposed between the receiving hole that are located at the middle of the rotating shaft and the gun body limit through hole 91.

The limiting structure is a limiting through hole 91 through which the rotary switch 12*a* passes, and a groove distributed along the center of the hole is provided in the hole for engaging with the ball 12*b*. The gun body 9 is provided with a limiting post 93. The inner end surface of the cam portion of the rotary switch 12*a* is provided with a limiting slot. After the rotary switch is installed, the limiting post 93 is accommodated in the limiting slot. Thus, when the rotary switch 12*a* is shifted, the limiting post 93 restricts the rotary switch 12*a* for rotating within a desired angular range.

After the elastic inverted portion is opened, the outer diameter is slightly larger than the inner diameter of the limiting through hole 91, so that the rotary switch 12*a* does not exit from the limiting through hole 91 after installation and axial wobble is prevented. By poking the shifting part of the cam portion, the rotary switch 12*a* is rotated, thereby adjusting the distance between the cam portion and the brake plate 5, thereby realizing the switching of the pressure release function of the adhesive cartridge and satisfying different requirements of the amount of pressure released for different adhesives.

Pre-set the cartridge pressure release device as needed before use. When applied to a case where the pressure relief of the adhesive cartridge is not required, as shown in FIG. 4, the shifting part of the cam portion of the rotary switch 12*a* is toggled counterclockwise, and the rotary switch 12*a* is turned to the upper limit position (shown by a broken line). While the rotary switch 12*a* is rotating, the inner compression spring 12*c* and the ball 12*b* are driven thereby to synchronously move relative to the groove of the gun body limit through hole 91, and when the ball 12*b* slides into the groove, a "beep" sound is emitted, and the rotary switch 12*a* is kept stable after the external force is lost. At this time, the cam portion of the rotary switch 12*a* abuts against the brake plate 5, and the separation distance is zero. In use, the brake plate 5 is first pressed with a finger to release the locking force applied by the brake spring 6 to the push rod 2, and then the push rod 2 is completely pulled back. At this time, the push disk 1 fixed to the front end of the push rod 2 is also moved to the rightmost side of the adhesive cartridge compartment 8. Then, the adhesive cartridge is placed inside the adhesive cartridge compartment 8. At this time, the trigger 7 is pulled, and the upper rivet 10 takes the lower rivet 11 as a pivot point of the rotation, and performs a circular path motion together with the trigger 7 which is riveted together therewith to push the push piece 4, and under the action of the friction force, the push rod 2 and the push piece 4 are together. The linear movement is performed forward, and the pusher plate 1 fixed on the push rod 2 pushes the piston in the adhesive cartridge, so that the colloid in the adhesive cartridge is squeezed from the front end thereof. After the release power of the trigger 7 is removed, the pusher 4 is quickly returned to its original position by the elastic force of the return spring 3, but the rear brake plate 5 is held in place by the cam portion, and the rear portion thereof is held against it. The gun body 9 and the push rod 2 are subjected to the reverse force transmitted through the piston when the inside of the adhesive cartridge is not completely released for a short time, but cannot be retracted due to the frictional force of the brake plate 5 and the brake pressure spring 6 acting together. In this case, the push rod 2 can only be pushed forward in one direction, and the piston inside the adhesive cartridge cannot be retracted. Therefore, the state at this time does not have the function of releasing the internal pressure of the adhesive cartridge like the common caulking gun. On the other hand, when it is applied to the case where the pressure relief of the adhesive cartridge is required, the shifting part of the cam portion of the rotary switch 12*a* is turned clockwise to disengage the cam portion of the rotary switch 12*a* from the brake plate 5 until the lower limit position is reached, and the rotary switch When the 12*a* rotates, the inner compression spring 12*c* and the ball 12*b* are synchronously moved with the groove of the gun body limit through hole 91, and when the ball 12*b* slides into the groove, a "beep" sound is emitted. The rotary switch 12*a* is kept stable after the external force is lost. At this time, the distance between the cam portion of the rotary switch 12*a* and the brake plate 5 is maximized. In use, the adhesive cartridge is also installed inside the adhesive cartridge compartment 8 according to the above steps, and the trigger 7 is pulled to perform the pressing operation. Different from the above process, since the brake plate 5 is not pressed by the cam portion of the rotary switch 12*a*, the pusher 2 advances the brake plate 5 to advance. After the driving force of the trigger 7 is removed, under the elastic force of the return spring 3, the pusher 4 is quickly returned to its initial position, and the push rod 2 is reversely pushed back by the piston under the pressure of the internal pressure of the adhesive cartridge, and the brake is synchronously driven. The plate 5 is returned back to the initial position so that the pressure inside the adhesive cartridge is quickly released. In this state, the caulking gun has an adhesive cartridge release function, and the release amount is maximized, so that automatic glue breaking can be achieved. Of course, according to actual needs, the rotary switch 12*a* can be dialed clockwise to a suitable position, and the required spacing between the cam portion of the rotary switch 12*a* and the brake plate 5 can be adjusted to meet the requirements of different gel release pressures. The invention has the characteristics of simple structure, low difficulty in processing and assembly process of parts, low cost and ideal effect.

Embodiment 3

Figure 7:
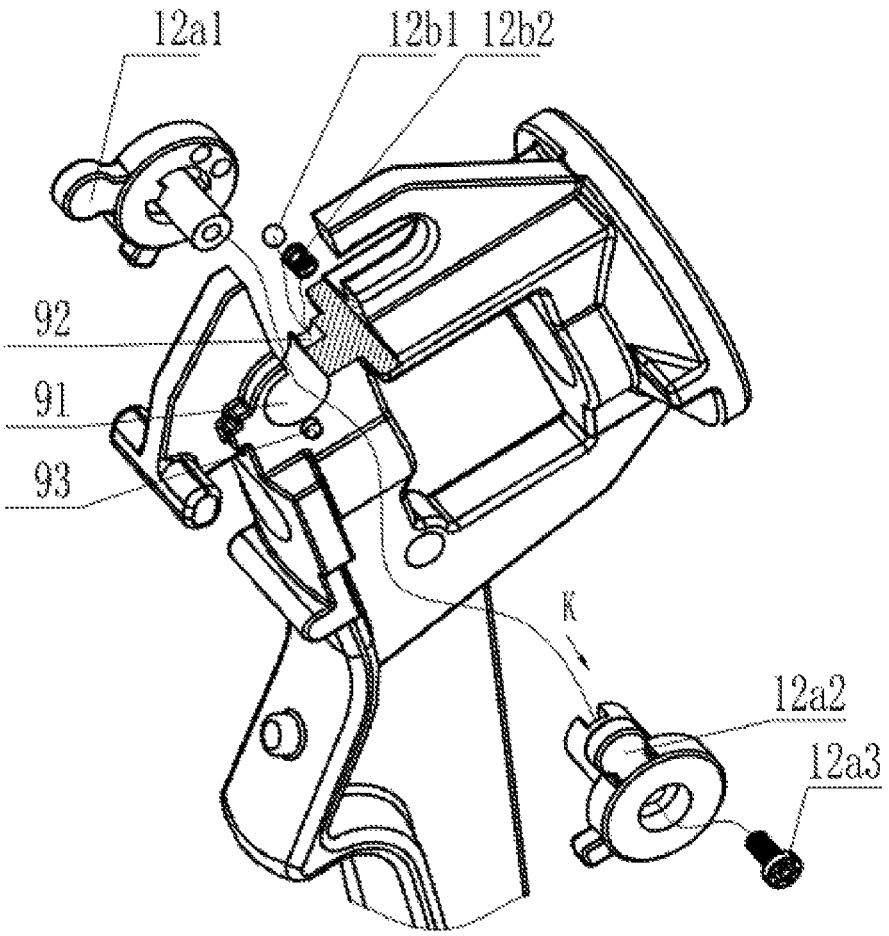
FIG. 7 is a schematic exploded view of another embodiment of the cartridge pressure release switching device of FIG. 3.
Figure 8:
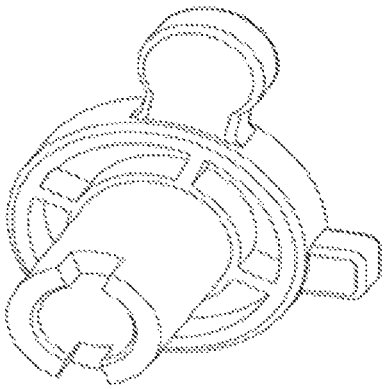
FIG. 8 is a view taken along the line K in FIG. 7.

Referring to FIG. 7 to FIG. 8 , the difference between Embodiment 3 and Embodiment 2 is that a positioning hole 91*a* and a limiting hole 92 for accommodating the resilient device are respectively disposed on the upper rear side of the gun body 9. The rotary switch includes a left rotary portion 12*a*1 and a right rotary portion 12*a*2 that pass through the locating hole 91 on the upper rear side of the gun body 9 face by face and are attached to the gun body 9 by screw 12*a*3. The resilient device is located in the limiting hole 92 and is compressingly mounted between the gun body and the rotary switch 12*a* by the inner end surface of the cam portion of the rotary switch 12*a*.

The left rotary portion 12*a*1 has a stepped shaft shape, and one end is provided with a cam portion, the outer ring of the cam portion is respectively provided with a dial portion and a square lug boss, the inner ring of the cam portion is provided with two convex blocks, and the inner end surface is provided with two dimples that are distributed along the axis of the left rotary portion 12*a*1 and at an angle to each other and cooperate with the ball 12*b*1, wherein one of the dimples corresponds to one of the lug bosses, and the outer end surface thereof has a switching indication mark.

The right rotary portion 12*a*2 has a stepped shaft shape, and one end is provided with a cam portion that is equal in size and opposite in position to the left rotary portion 12*a*1. When the two rotary portions are mounted, the dialing portion and the lug boss are just at the same position, and the shaft diameter of the right rotary portion 12*a*2 is slightly larger than the shaft diameter of the left rotary portion 12*a*1, and a through hole for accommodating the shaft portion of the left rotary portion 12*a*1 is provided in the shaft of the right rotary portion 12*a*2, and the end surface of the right rotary portion 12*a*2 is provided with a counter bore through which the head of the screw 12*a*3 passes, and the shaft end of the right rotary portion 12*a*2 is provided with two grooves corresponding to the convex blocks on the left rotary portion 12*a*1, and the left rotary portion 12*a*1 and the right rotary portion 12*a*2 are stably fixed in the radial direction by the concave-convex groove fitting.

The operation of Embodiment 3 is similar to that of Embodiment 1: when the function of cartridge pressure releasing is not required, the shifting part of the rotary switch 12*a*1 or 12*a*2 is toggled so that the lower limit end of the limit groove in the inner end surface of the right rotary portion 12*a*2 abuts the limiting post 93 on the gun body 9. Moreover, the limiting hole 92 on the gun body 9 is exactly coaxial with one of the dimples on the inner end surface of the cam portion of the left rotary portion 12*a*1, and the compression spring 12*b*2 pushes the ball 12*b*1 into the dimple and makes a "beep" sound, and after the loss of external force, it will not autorotate and keep stable. At this time, the square lug bosses on both sides of the left and right rotary portions firmly hold against the brake plate 5 at the same time, restricting the movement of the brake plate 5, and the caulking gun does not have the function of adhesive cartridge pressure releasing.

On the other hand, when the function of releasing the pressure of the adhesive cartridge is required, it is only necessary to toggle the shifting part of the rotary switch to disengage the square lug bosses of the cam portion from the above mentioned brake plate 5. At this time, the upper limit end of the limit groove of the inner end surface of the right rotary portion 12*a*2 is against the limiting post 93 on the gun body 9. Further, the limiting hole 92 on the gun body 9 is exactly coaxial with the other dimple of the inner end surface of the cam portion of the left rotary portion 12*a*1, and the compression spring 12*b*2 pushes the ball 12*b*1 into the dimple and makes a "click" sound, and after the loss of external force, it will not autorotate and keep stable.

Embodiment 4

Figure 9:
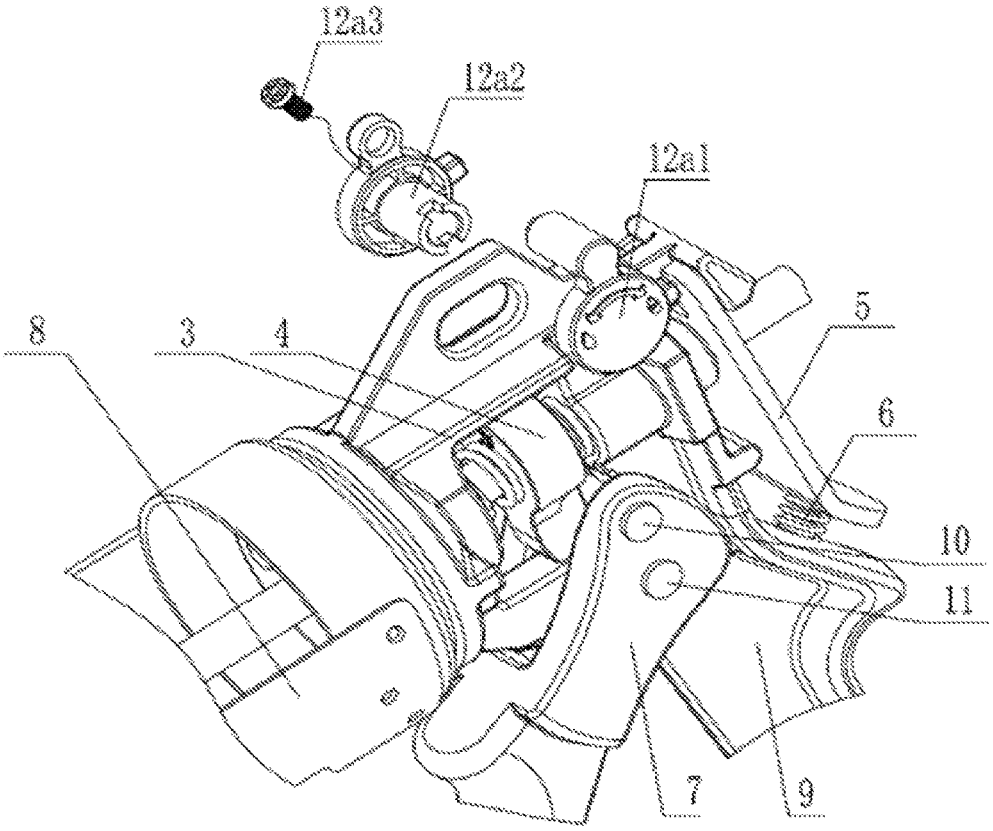
FIG. 9 is a schematic exploded view of another embodiment of the cartridge pressure release switching device of FIG. 3.

Referring to FIG. 9, Embodiment 4 is different from the third embodiment in that the dial portion of the cam portion of the left rotary portion 12*a*1 extends to the inner side thereof in the shape of a small shaft parallel to the shaft of the left rotary portion 12*a*1 and in the same direction. There is a small shoulder on the end of the shaft.

The right rotary portion 12*a*2 is provided with a counterbore for fixing the shoulder of the shaft of the left rotary portion 12*a*1, and when the left and right rotary portions are coupled together by the screw 12*a*3, the extended shaft shoulder of the left rotary portion 12*a*1 is just inserted into the counterbore of the right rotary portion 12*a*2, and the surface contact area of the rotary switch is greatly increased by the action of the extended shaft, thereby improving the comfort of use.

Embodiment 5

Figure 10:
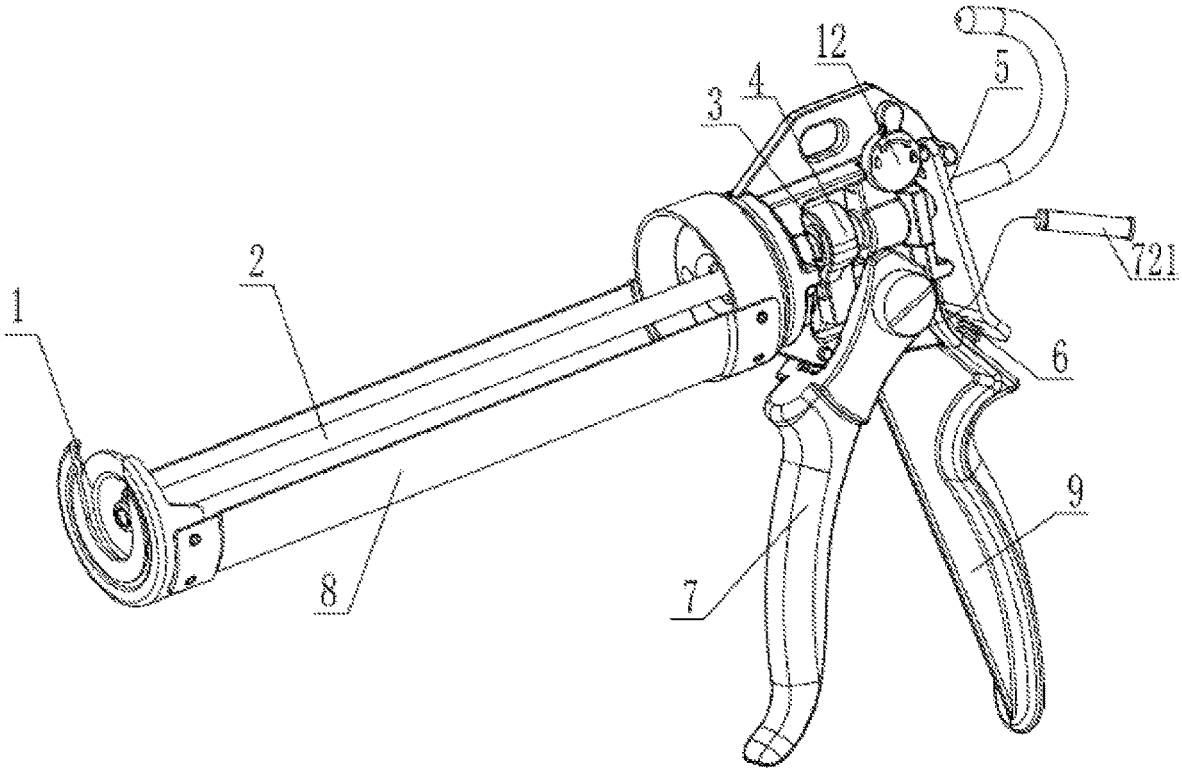
FIG. 10 is a schematic view showing the structure of another embodiment of the present invention.

Referring to FIG. 10, a caulking gun provided by Embodiment 5 includes a pin switching device and a cartridge pressure release switching device, including a push disk 1, a push rod 2, an adhesive cartridge compartment 8, a trigger 7 and a gun body 9. The trigger 7 is hinged to the middle of the gun body 9 by a pin 721 to cooperate with the lower portion of the gun body 9 for rubberizing. The adhesive cartridge compartment 8 is disposed at the front end of the gun body 9; the rear end of the push rod 2 is located outside the gun body 9, and the front end passes through the gun body 9 and is located in the adhesive cartridge compartment 8. The push disk 1 is disposed at the front end of the push rod 2. The rear end of the push rod 2 is provided with a braking device, and the gun body 9 is mounted with a push piece 4 for driving the push rod 2 to advance. The front end of the push piece 4 is provided with a return spring 3; the trigger 7 is provided with a pin position switching device for adjusting the advancement ratio. The upper portion of the gun body 9 is provided with a rotatable cartridge pressure release switching device 12 pin-connected thereto. The cartridge pressure release switching device 12 is rotatable between a first position and a second position, and when in the first position, is in contact with the brake plate, and the pressure of the adhesive cartridge is maintained during the rubberizing process of the caulking gun; when in the second position, it is separated from the brake plate, and the pressure of the adhesive cartridge is releasing during the rubberizing process. For the specific structure of the pin position switching device, refer to the pin position switching device according to the first embodiment. For the specific structure of the adhesive cartridge pressure release device 12, refer to the cartridge pressure release device 12 described in the second embodiment or the third embodiment or the fourth embodiment.

The invention claimed is:

1. A caulking gun comprising:

a push disk, a push rod, an adhesive cartridge compartment, a trigger and a gun body;

the trigger is hingedly coupled to a middle part of the gun body and cooperates with a lower part of the gun body to squeeze an adhesive, and the adhesive cartridge compartment is disposed at a front end of the gun body; a rear end of the push rod is located outside the gun body, and the front end of the push rod passes through the gun body and is disposed in the adhesive cartridge compartment;

the push disk is disposed at a front end of the push rod, and the rear end of the push rod is provided with a braking device;

a push piece for driving the push rod is mounted in the gun body, and the front end of the push piece is provided with a return spring;

wherein the trigger is provided with a pin position switching device for adjusting a propulsion ratio;

an upper portion of the trigger is a u-shaped opening, and the gun body is inserted into the u-shaped opening and hinged to the trigger by a pin;

a plurality of grooves are provided on one side of the u-shaped opening;

the pin position switching device comprises a camshaft pin that is rotatable and can be positioned in the plurality of grooves; the camshaft pin having a first cam portion for cooperating with the grooves to fix a position of the camshaft pin thereto, and a second cam portion for contacting with the push piece to adjust the propulsion ratio; the first cam portion and the second cam portion are synchronously rotated and positioned.

2. The caulking gun of claim 1, wherein said camshaft pin comprises a cylindrical pin; said first cam portion is disposed at a first end of the cylindrical pin; said second cam portion is disposed at a middle portion of the cylindrical pin; a second end portion of the cylindrical pin passes through the trigger and the gun body to fixedly connected with a screw that can drive the camshaft pin to move away from the grooves; an outer surface of the second end of the cylindrical pin is provided with a compression spring, and the compression spring is located between the inner side of the screw and the trigger.

3. The caulking gun according to claim 1, wherein the grooves are through holes each having a shape that corresponds with the first cam portion.

* * * * *